United States Patent [19]

Oida

[11] Patent Number: 4,483,161

[45] Date of Patent: Nov. 20, 1984

[54] WASHING APPARATUS

[75] Inventor: Susumu Oida, Komaki, Japan

[73] Assignee: Tokyo Shibaura Denki Kabushiki Kaisha, Kawasaki, Japan

[21] Appl. No.: 336,041

[22] Filed: Dec. 31, 1981

[30] Foreign Application Priority Data

Mar. 14, 1981 [JP] Japan ..... 56-37071

[51] Int. Cl.[3] ..... D06F 23/04

[52] U.S. Cl. ..... 68/23.6

[58] Field of Search ..... 68/23.6, 23.7, 18 D, 68/18 F, 133, 136

[56] References Cited

U.S. PATENT DOCUMENTS

| | | | |
|---|---|---|---|
| 2,071,622 | 2/1937 | Gibson | 68/136 |
| 2,303,979 | 12/1942 | Blake | 68/23.7 X |
| 2,973,637 | 3/1961 | Sisson | 68/23.6 X |
| 3,306,082 | 2/1967 | Hasegawa et al. | 68/23.6 X |
| 4,202,187 | 5/1980 | Hukuzawa et al. | 68/23.6 X |

FOREIGN PATENT DOCUMENTS

| | | | |
|---|---|---|---|
| 229806 | 8/1960 | Australia | 68/23.6 |
| 149270 | 11/1979 | Japan | 68/23.6 |

*Primary Examiner*—Robert E. Garrett
*Assistant Examiner*—Joseph M. Pitko
*Attorney, Agent, or Firm*—Schwartz, Jeffery, Schwaab, Mack, Blumenthal & Koch

[57] ABSTRACT

Disclosed is a washing apparatus having a spinnable tub for receiving a liquid together with materials to be washed and for discharging the liquid therein through its upper portion by a pumping action caused by centrifugal forces, a pulsator disposed in the spinnable tub on the bottom thereof at an eccentric position with respect to the axis of the rotation of the spinnable tub, and resistive means located in the spinnable tub at a region substantially diametrically opposite to the pulsator, whereby resistance to the liquid rotating in the spinnable tub caused by the pulsator and the resistive means is balanced with respect to the axis of rotation of the spinnable tub.

7 Claims, 7 Drawing Figures

WASHING APPARATUS

BACKGROUND OF THE INVENTION

The present invention relates to a washing apparatus and more particularly to an improvement of a washing apparatus having a pulsator disposed eccentrically on the inside bottom of a spinnable tub.

In a washing apparatus of the type having a pulsator eccentrically disposed on the bottom of the spinnable tub for increasing washing power, a spinnable tub without perforations, at least below the washing liquid level, rotates to cause liquid to be carried upwardly and to be discharged through its upper portion.

With such an arrangement, however, rotation of the spinnable tub, especially when a small amount of materials is washed, forces liquid to rotate as the liquid surface assumes an inverted paraboloid. At this time, a mass of liquid tends to rise on the pulsator and hence to be shifted off-center more toward the pulsator. Thus, the spinnable tub, while rotating with liquid therein, has a shifted center of gravity, which is a source of abnormal vibrations to which the spinnable tub is subjected. This phenomenon is considered to take place when the spinnable tub is driven to rotate at a speed different from that of rotation of the liquid caused by the spinnable tub, and with such relative rotation between the spinnable tub and the liquid, the projecting pulsator acts as a resistance to the rotating mass of liquid, which is slowed down and rises on the pulsator. The marked tendency to rotate with abnormal vibrations is seen when a small amount of materials is to be washed in the spinnable tub. The conventional washing apparatus of the aforesaid type, therefore, generally has an excessive expenditure for the supporting mechanism to absorb such abnormal vibrations due to the displaced mass of liquid. Furthermore, considering that a flatter pulsator is disposed at the bottom of the spinnable tub to eliminate this problem, this results in a decrease in washing power.

SUMMARY OF THE INVENTION

Therefore, it is an object of the present invention to provide a novel and improved washing apparatus including a pulsator disposed at an eccentric position with respect to the axis of rotation of the spinnable tub.

It is another object of the invention to provide a washing apparatus including resistive means to resist liquid rotating in the spinnable tub during a spin-drying cycle.

It is a further object of the invention to provide a washing apparatus which prevents rotation of the spinnable tub with abnormal vibration.

It is still another object of the invention to provide a washing apparatus wherein the spinnable tub which is provided with a pulsator disposed at an eccentric position spins stably even though a small amount of materials is being washed in the spinnable tub.

It is furthermore an object of the invention to provide a washing apparatus which has an increased washing power and which stably spins the spinnable tub.

In accomplishing the foregoing objects, there has been provided according to the present invention a novel washing apparatus comprising a spinnable tub for receiving a liquid and materials to be washed and for discharging the liquid therein through its upper portion by pumping action caused by centrifugal forces, a pulsator disposed in the spinnable tub on the bottom thereof at an eccentric position with respect to the axis of rotation of the spinnable tub and resistive means located in a region of the spinnable tub which is substantially diametrically opposite to the pulsator and which resists rotation of the liquid in the spinnable tub, whereby the resistance caused by both the pulsator and the resistive means is balanced with respect to the axis of rotation of the spinnable tub.

Other objects, features and attendant advantages of the invention will become readily apparent as the apparatus becomes better understood by reference to the following detailed description of preferred embodiments, when considered in connection with the accompanying drawings.

BRIEF DESCRIPTION OF THE DRAWINGS

In the drawings, forming a part hereof, in which like reference characters denote like parts in the various views.

DETAILED DESCRIPTION OF PREFERRED EMBODIMENTS

Figure 1:
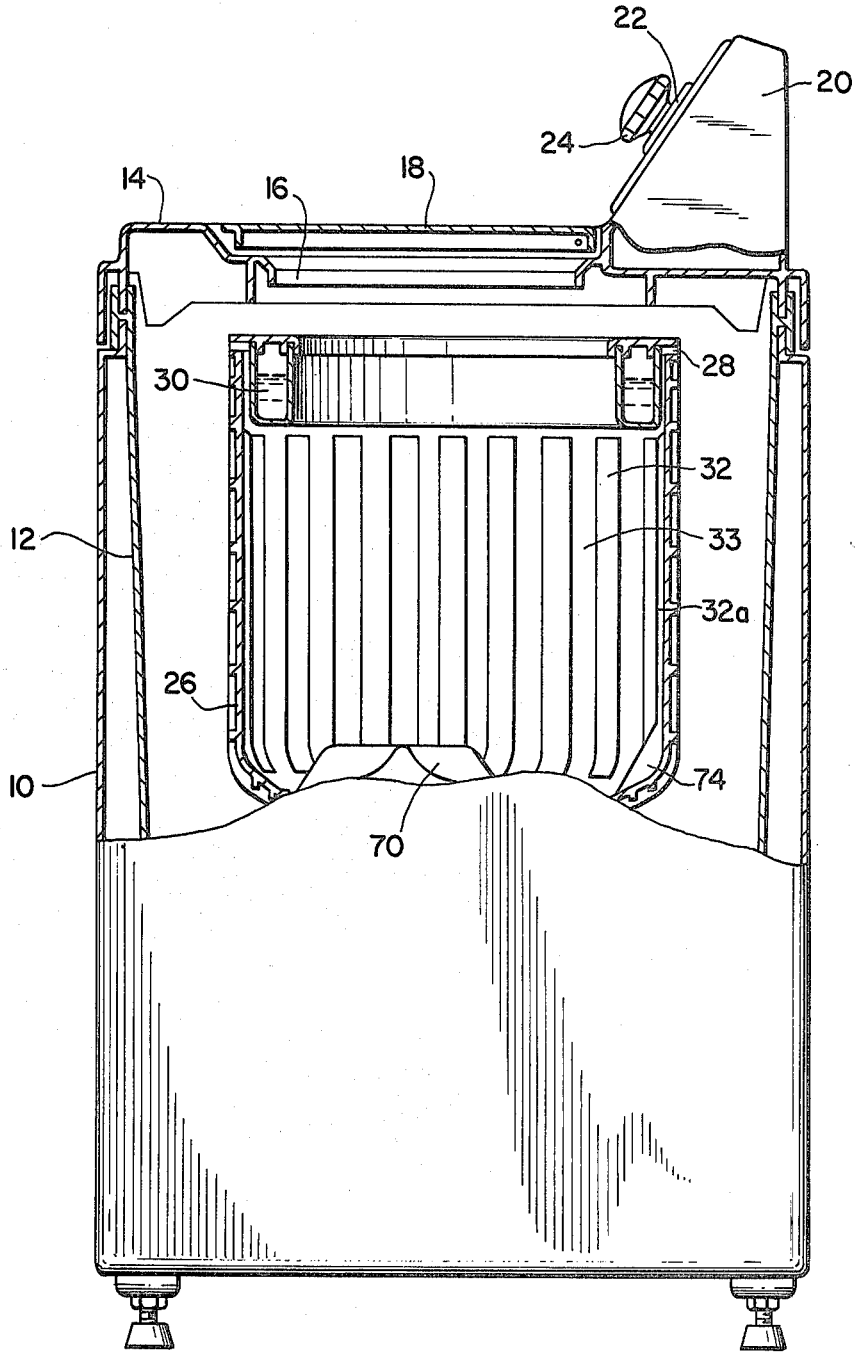
FIG. 1 is a side view, partially in section, of a washing apparatus according to the first embodiment of the invention.

Now there will be described a first embodiment of the invention according to FIGS. 1 through 4. In FIG. 1, which shows the overall structure in general, an outer casing 10 houses therein an outer tub 12 and has its open top covered by a cover 14 having a substantially central opening 16 through which materials to be washed can be placed into and taken out of the tub 12. The central opening 16 is covered by a hinged lid 18. An upstanding control box 20 is disposed rearwardly of the cover 14 and houses therein a timer switch 22 having a knob 24.

A spinnable tub 26 which doubles as a washing tub is disposed in the outer tub 12 and has no holes, at least below the washing liquid level. A draining gap 28 is defined between its upper edge and a balance ring 30 is mounted in the upper opening of the spinnable tub 26. The spinnable tub 26 can contain washing liquid therein and discharges the liquid through its upper portion by pumping action caused by centrifugal forces. The spinnable tub 26 has a plurality of longitudinal vanes 32, which are formed so as to project radially inwardly in its side wall, to define channels 33 therebetween through which the liquid within the spinnable tub 26 can move freely toward the draining gap 28 in the spin-drying step.

Figure 2:
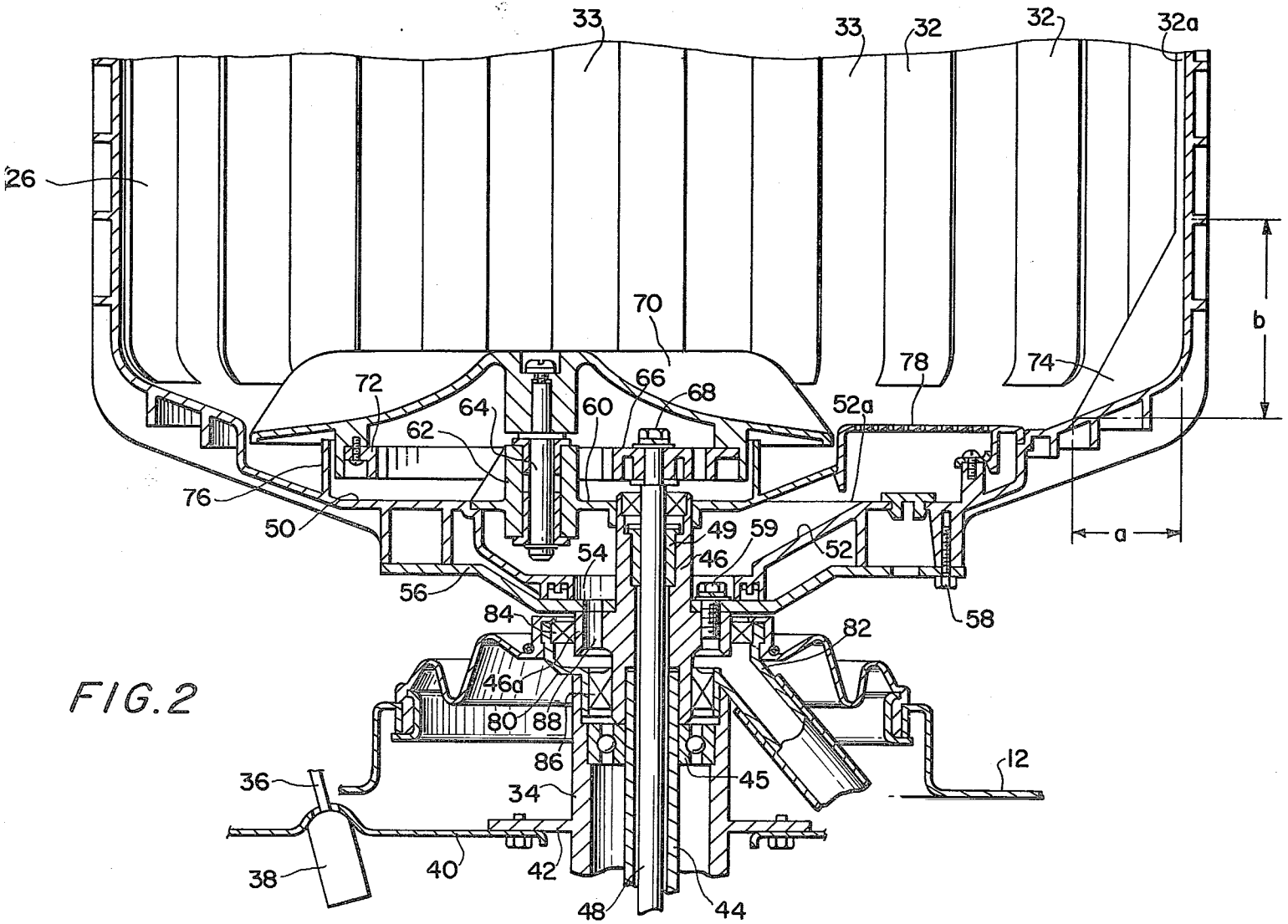
FIG. 2 is an enlarged fragmentary vertical cross-sectional view of the washing apparatus according to the first embodiment of the invention.

FIG. 2 illustrates a support structure for the spinnable tub 26. A housing 34 for a drive mechanism (not shown) is located below the outer tub 12 and resiliently suspended from the outer tub 12 by a hanger rod 36 of a resilient supporting mechanism 38 through the support plate 40 fixed to flange 42 of housing 34. A hollow shaft 44 extends through housing 34 and is supported by the bearing 45. A sleeve connecting shaft 46 is fitted over the upper end portion of the hollow shaft 44. A solid shaft 48 extends coaxially through and is supported by the bearing 49 in the hollow shaft 44 and the sleeve connecting shaft 46. Although not shown, the hollow shaft 44 and the shaft 48 are connected to a motor through a clutch mechanism, and rotational power from the motor can be transmitted selectively to the shafts 44 and 48 under the control of the clutch mechanism. The spinnable tub 26 has in the bottom thereof a recess 50 positioned off-center or spaced a given interval from the axis of rotation of the tub 26 for receiving therein at least the bottom portion of a pulsator, to be described more fully below. The tub bottom also has therein a slot 52 extending from the center of the recess 50 across the center of the tub bottom to the right in FIG. 2. The slot 52 has at its bottom a cavity 54 of a relatively large diameter through which the sleeve connecting shaft 46 extends. The spinnable tub 26 is connected to the hollow shaft 44 by a reinforcing bottom plate 56 fastened to the underside of the bottom of the spinnable tub 26 by bolts 58 and fitted around and secured to the flange **46*a* of the sleeve connecting shaft 46 by bolts 59. A base plate 60 closes the slot 52 extending below the recess 50 except for an opening 52*a* adjacent to a strainer described below. A bearing sleeve 62 projects from the base plate 60 at its portion positionally corresponding to the center of the recess 50. A shaft 64 is rotatably supported in the bearing sleeve 62. A drive gear 66 is fixed by a screw 68 to the upper end of the shaft 48 which projects into the recess 50. A pulsator 70 is disposed in the recess 50 and is screwed to the shaft 64. An internal gear or driven gear 72 is attached to the underside of the pulsator 70 and is held in mesh with the drive gear 66. As the result, the pulsator 70 is disposed in an eccentric position with respect to the axis of rotation of the spinnable tub 26**.

Figure 3:
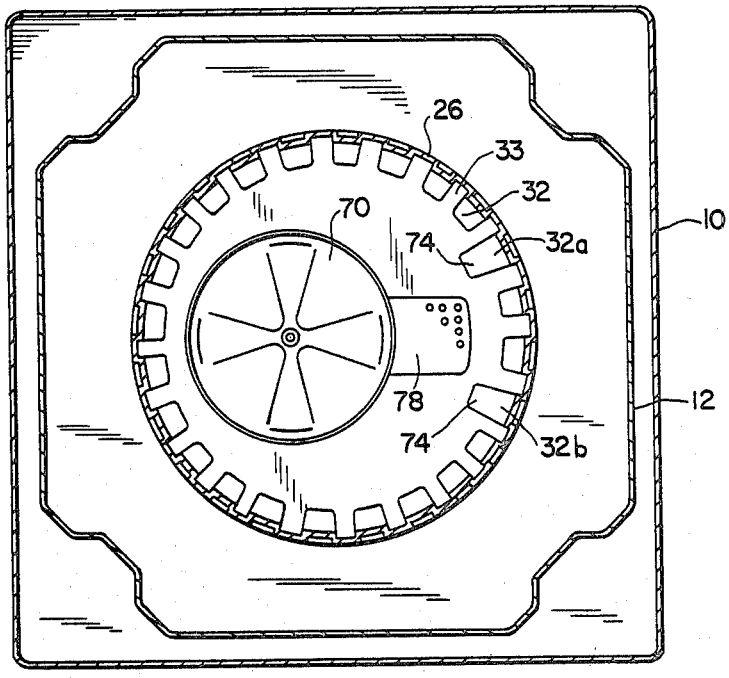
FIG. 3 is a horizontal cross-sectional view of the washing apparatus according to the first embodiment of the invention.

Resistive means or projections 74, two in number for example, are disposed in a region substantially diametrically opposite to the pulsator 70 within the spinnable tub 26. The projections 74 are formed so as to extend inwardly and downwardly from the lower portions of two of the vanes 32, e.g., **32*a* and 32*b* to bridge the lower portions of the two vanes, or alternatively, the lower portions of the side wall of the spinnable tub 26 with the peripheral portions of the bottom wall of the spinnable tub 26 as shown in FIGS. 2 and 3. An annular shield wall 76 is formed continuously on the bottom of the recess 50 and the base plate 60 in a position outside of the driven gear 72 to prevent entry of materials to be washed or of foreign matter, such as sand. A strainer 78 closes the opening 52*a* of the slot 52 at the bottom of the spinnable tub 26**.

A vessel 80, which has a drain tube 82 at its bottom, is fixed at the top end of the housing 34 and surrounds the under side of the flange **46*a* of the connecting shaft 46. Seals 84 and 86 are arranged respectively between the flange 46*a* of the connecting shaft 46 and the vessel 80, and between the connecting shaft 46 and the vessel 80. A passageway 88 is formed through the bottom plate 56 and the flange 46*a* of the housing 46 to connect the recess 50 and vessel 80 therethrough. Although not shown, the outer tub 12 has at its bottom a drain tube for discharging liquid out of the tub 12**.

The operation of this embodiment of the invention will now be described as follows: When materials to be washed and a detergent are put into the spinnable tub 26, the timer switch is set, whereupon a water supply valve (not shown) is opened to supply liquid or water into the spinnable tub 26. When liquid reaches a predetermined level, a liquid level sensing switch (not illustrated) is actuated to close the liquid supply valve and at the same time to energize the motor, thereby rotating the shaft 48. The pulsator 70 is now driven to rotate through the drive gear 66 and internal gear 72 to wash the material with the detergent. During the washing step, the center of the whirlpool of the liquid caused by the pulsator 70 is eccentric to the center of the spinnable tub 26, resulting in an increased washing power. In addition, the liquid is caused by the projections 74 on the bottom of the spinnable tub 26 to flow in a disturbed or agitated manner, also resulting in an increased washing power. When the washing step is over, the apparatus now enters the draining and spin-drying steps, in which the clutch mechanism is actuated to enable the spinnable tub 26 to be rotated at a high speed through the hollow shaft 44. The liquid in the spinnable tub 26 rotates with the latter and is caused under centrifugal forces to be guided or be raised up the channels 33 of the inner peripheral surface of the spinnable tub 26. The liquid is then discharged into the outer tub 12 through the draining gap 28 at the top of the spinnable tub 26 and out of the apparatus through the drain tube and a draining hose (not shown). The liquid passed through the strainer 78 is discharged from the drain tube 82 via the cavity 54 of the recess 52, the passageway 88 and the vessel 80.

Figure 4:
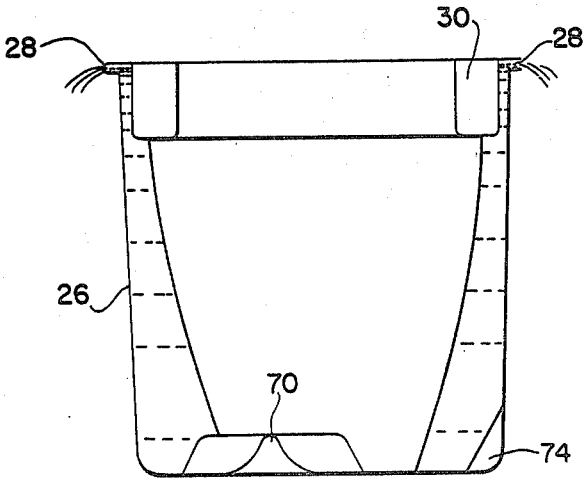
FIG. 4 is a schematic vertical view illustrative of the way in which the washing apparatus according to the first embodiment of the invention operates.

In the spin-drying step, the liquid in the spinnable tub 26 does not rotate in complete synchronism with the spinnable tub 26, but rotates at a speed slightly slower than that of rotation of the spinnable tub 26. Therefore, the tub 26 and the liquid contained therein rotate relative to each other. The eccentrically disposed pulsator 70 acts to resist the liquid thus rotating relative to the spinnable tub 26, and the projections 74 which are diametrically opposite to the pulsator 70 also act as a resistance to rotation of the liquid. Thus, the liquid rotating in the spinnable tub 26 is acted on to keep the balance of the resistance of the pulsator 70 and the projections 74 with respect to the center of the rotation of the spinnable tub 26. The same amount of liquid with respect to the center of the rotation of the spinnable tub 26 is therefore caused to rise on both sides of the pulsator 70 and the projections 74, resulting in a substantially uniform distribution of rising liquid around the entire inner peripheral surface of the spinnable tub 26, as illustrated in FIG. 4. The spinnable tub 26 can be prevented from being locally loaded and carries a load substantially uniformly distributed around the entire spinnable tub 26, with the consequence that the spinnable tub 26 can be rotated at a high speed without being subjected to abnormal vibrations for extracting the liquid from the materials being washed.

The amplitude of vibration of the spinnable tub 26 is dependent on the resilient supporting mechanism, the draining system, and the dimensions of all of the parts which comprise a vibration system. The experiments made in order to confirm the effect of the resistive projections showed the following results of measuring the amplitude of the top portion of the spinnable tub.

| Case | Dimensions of Projection(s) Height a | Length b | Number | The Amplitude of the Vibration of the Spinnable Tub |
|---|---|---|---|---|
| 1 | 40 mm | 70 mm | 1 | 18 mm |
| 2 | 30 | 60 | 1 | 22 |
| 3 | 20 | 40 | 1 | 32 |
| 4 | 20 | 20 | 1 | 43 |
| 5 | 20 | 20 | 2 | 28 |
| 6 | 0 | 0 | 0 | 55 |

Numerals a and b in the TABLE are, respectively, the height and length of the projections 74 as shown in FIG. 2. In this connection, the dimensions of some parts of the model used for measuring the amplitude of the vibrations of the spinnable tub in the cases are as follows: the diameter of the spinnable tub: 420 mm, the height of the spinnable tub: 450 mm, the diameter of the pulsator: 220 mm, the height of the pulsator: 45 mm, the distance between the axis of the spinnable tub and the axis of the pulsator: 40 mm.

In the case wherein the projection had larger dimensions than those in CASE 1, the amplitude of the vibration of the spinnable tub 26 became larger than that of CASE 1.

With the embodiment illustrated, no increase in the cost of manufacture is entailed, since a conventional resilient supporting mechanism and balance ring 30 can be utilized in the apparatus. After the draining and spin-drying steps have been finished, liquid is again supplied into the spinnable tub 26 and the pulsator 70 is driven to carry out a rinsing step. Such a rinsing step is followed by draining and spindrying steps, and these steps are repeated in sequence before a full process is completed.

Figure 5:
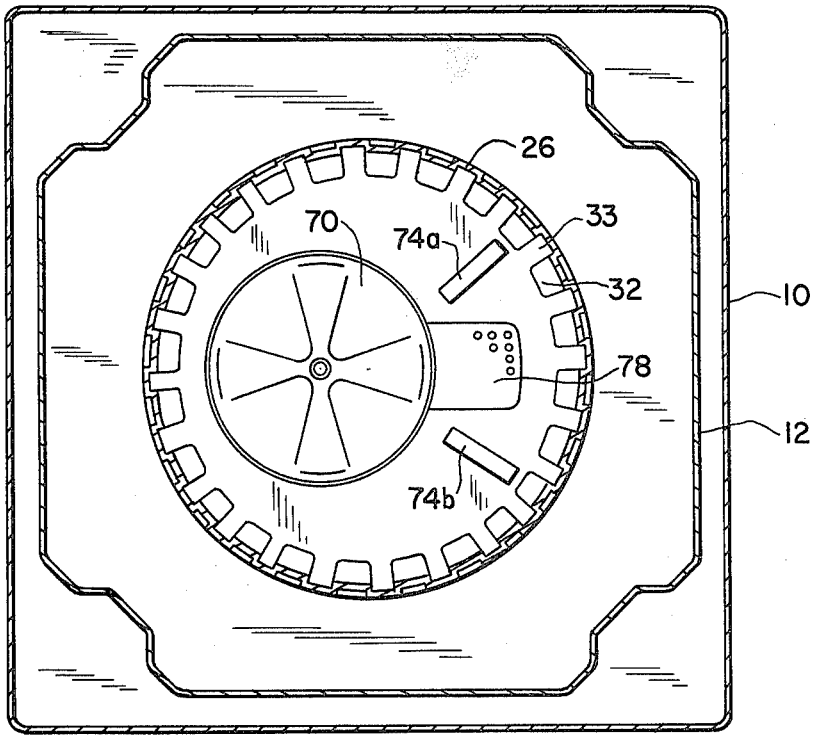
FIGS. 5 and 6 are horizontal cross-sectional views of the washing apparatus according to the second and third embodiments of the invention, respectively.

While in the first embodiment the projections 14 constituting the resistive bodies are formed with the two vanes 32*a* and 32*b* to bridge the lower portions of the side wall and the peripheral portions of the bottom wall of the spinnable tub 26, the invention is not limited to such an arrangement, but instead, projections 74*a* and 74*b*, may be formed separately from the vanes 32, directly on the bottom surface as shown in FIG. 5.

Figure 6:
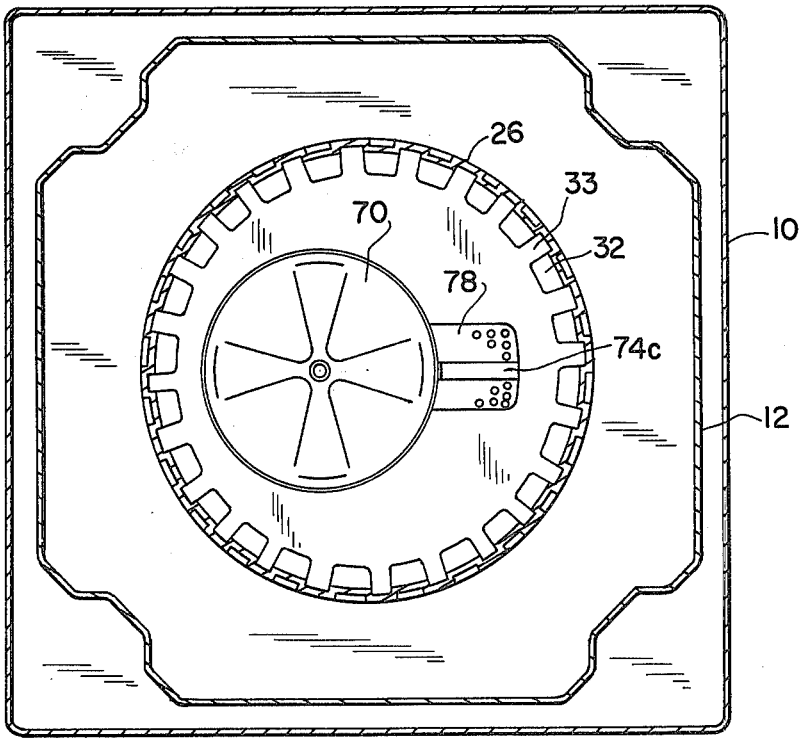
Figure 7:
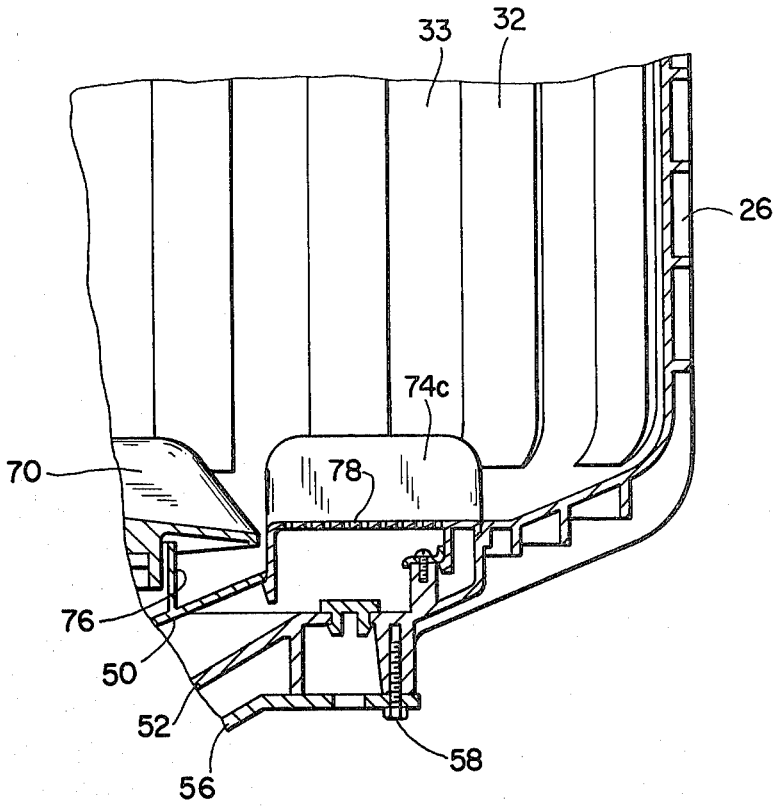
FIG. 7 is an enlarged fragmentary vertical cross-sectional view of the washing apparatus according to the third embodiment of the invention.

Further, the strainer 78 may have a projection 74*c* as a resistive body, as shown in FIGS. 6 and 7. Stated otherwise, the same advantage as that of the first illustrated embodiment can be reached by providing something resistive to the rotation of liquid at a region diametrically opposite to the pulsator 70 with respect to the axis of the rotation of the spinnable tub 26.

What is claimed is:

1. A washing apparatus, comprising:

a spinnable tub having a side wall and a bottom wall for receiving a liquid and materials to be washed and for discharging the liquid therein through its upper portion by pumping action caused by centrifugal force;

a pulsator disposed in said spinnable tub on the bottom at an eccentric position with respect to the axis of rotation of said spinnable tub; and at least one resistance means, said resistance means confined to a region of said spinnable tub which is substantially diametrically opposite to said pulsator, for resisting rotation of liquid in said spinnable tub during a spin drying step to effect with the resistance of said pulsator a substantially uniform distribution of liquid rising around the peripheral surface of said spinnable tub, all of said resistive means being asymmetrically disposed relative to the central axis of said spinnable tub.

2. A washing apparatus according to claim 1, wherein said resistive means comprises at least one projection formed inwardly of the side wall of said spinnable tub.

3. A washing apparatus according to claim 1, wherein said resistive means comprises at least one projection formed inwardly and integrally with the side wall of said spinnable tub.

4. A washing apparatus according to claim 1, wherein said resistive means comprises at least one projection formed on said bottom wall of said spinnable tub.

5. A washing apparatus according to claim 1, wherein said resistive means comprises at least one projection formed so as to bridge from said side wall to said bottom wall of said spinnable tub.

6. A washing apparatus according to claim 1, wherein said spinnable tub comprises a plurality of longitudinal vanes forming therebetween a plurality of channels along its side wall for guiding a liquid to the upper portion of said spinnable tub by means of centrifugal force, and said resistive means comprises at least one projection formed extending from the lower portion of at least one of said vanes.

7. A washing apparatus according to claim 1, wherein said spinnable tub comprises a strainer on its bottom wall, and said resistive means comprises a projection arranged on said strainer.

* * * * *